US006324708B1

(12) United States Patent
Langley

(10) Patent No.: US 6,324,708 B1
(45) Date of Patent: Dec. 4, 2001

(54) SPA/HOT TUB COVER HOLDER

(76) Inventor: Joe L. Langley, P.O. Box 233, Liberty Hill, SC (US) 29074

( * ) Notice: Subject to any disclaimer, the term of this patent is extended or adjusted under 35 U.S.C. 154(b) by 0 days.

(21) Appl. No.: 09/471,819

(22) Filed: Jul. 18, 2000

(51) Int. Cl.[7] ..... A47K 3/00
(52) U.S. Cl. ..... 4/559; 4/498; 211/13.1
(58) Field of Search ..... 4/498, 559; 280/47.16, 280/47.34, 79.7, 33.991; 211/41.15, 13.1; D34/21

(56) References Cited

U.S. PATENT DOCUMENTS

| | | | | |
|---|---|---|---|---|
| 1,330,891 | * | 2/1920 | Merrill | 280/47.34 |
| 3,669,464 | * | 6/1972 | Linzmeier | 280/47.34 |
| 4,679,805 | * | 7/1987 | Cunningham | 280/33.991 |
| 4,991,238 | * | 2/1991 | Forrest | 4/498 |

* cited by examiner

*Primary Examiner*—Charles E. Phillips

(74) *Attorney, Agent, or Firm*—Adams, Schwartz & Evans, P.A.

(57) ABSTRACT

A freestanding spa cover holder for storing a cover when not in place on the spa. The cover holder includes a horizontally-disposed base having first and second horizontally-oriented and spaced apart major base rails. First and second horizontally-oriented and spaced apart minor base rails are perpendicularly disposed between and connected to the opposing major base rails. A tall first support rail is mounted on the base and extends upwardly along the entire length of the major base rails. The first support rail has a first predetermined height and defines a back support against which the cover is received. A low second support rail is mounted on the base in spaced-apart relation to the first support rail and extends along less than the entire length of the major base rails. The second support rail has a second predetermined height at least less than one half of the first predetermined height and defines with the base and the first support rail a structure for permitting the cover to be positioned between the first and second support rails for full support of a leaning side of the cover against the first support rail while permitting the cover to be lifted only over the low second support rail when placing the cover in and removing the cover from the holder.

7 Claims, 4 Drawing Sheets

SPA/HOT TUB COVER HOLDER

TECHNICAL FIELD AND BACKGROUND OF THE INVENTION

This invention relates to a spa/hot tub cover holder ("spa cover holder"). The spa cover holder is used for storing a spa cover when the cover is not in place on a spa. When properly assembled, the spa cover holder will accommodate spa or hot tub covers of different sizes ranging from small to extra-large. The cover holder of the present invention has a unique structure which prevents a spa or hot tub cover placed thereon from moving around, being damaged, or from falling to the ground or floor upon which the cover holder is positioned.

SUMMARY OF THE INVENTION

Therefore, it is an object of the present invention to provide a spa cover holder for preventing a spa cover inserted therein from moving around, being damaged, or falling from the cover holder onto the ground or floor upon which the cover holder is positioned.

It is another object of the present invention to provide a spa cover holder which will accommodate spa or hot tub covers having different sizes ranging from small to extra-large.

These and other objects of the present invention are achieved in the preferred embodiments disclosed below by providing a freestanding spa cover holder for storing a cover when not in place on the spa. The cover holder includes a horizontally-disposed base having first and second horizontally-oriented and spaced apart major base rails. First and second horizontally-oriented and spaced apart minor base rails are perpendicularly disposed between and connected to the opposing major base rails. A tall first support rail is mounted on the base and extends upwardly along the entire length of the major base rails. The first support rail has a first predetermined height and defines a back support against which the cover is received. A low second support rail is mounted on the base in spaced-apart relation to the first support rail and extends along less than the entire length of the major base rails. The second support rail has a second predetermined height at least less than one half of the first predetermined height and defines with the base and the first support rail a J-shaped structure for permitting the cover to be positioned between the first and second support rails for full support of a leaning side of the cover against the first support rail while permitting the cover to be lifted only over the low second support rail when placing the cover in and removing the cover from the holder.

According one preferred embodiment of the invention, the first support rail extends between the first and second minor base rails and includes one end connected to a respective one of the first and second minor base rails and another end connected to the other of the first and second minor base rails.

According to another preferred embodiment of the invention, the second support rail extends along the length of the first major base rail and includes first and second ends connected thereto.

According to yet another preferred embodiment of the invention, the second support rail extends along the length of the second major base rail and includes first and second ends connected thereto.

According to yet another preferred embodiment of the invention, the cover holder includes a plurality of vertically-oriented, spaced apart support legs connected to the base in a predetermined configuration. The legs extend outwardly from the base in a direction opposite the first and second support rails for supporting and maintaining the cover holder above the surface upon which the cover holder is positioned.

According to yet another preferred embodiment of the invention, the base further includes at least one horizontally-oriented base rail segment having one end connected to a respective one of the first and second major base rails and the other end connected to the other one of the first and second base rails for providing reinforcing support to the base.

According to yet another preferred embodiment of the invention, the cover holder includes a plurality of vertically-oriented, spaced apart support legs connected to the major and minor base rails and the at least one base rail segment in a predetermined configuration. The legs extend outwardly away from the base in a direction opposite the first and second support rails for supporting and maintaining the cover holder above the surface upon which the cover holder is positioned.

According to yet another preferred embodiment of the invention, the cover holder includes a vertically-oriented reinforcing rail having one end connected to the first support rail between the first and second ends thereof, and the other end connected to one of the base rail segments for providing reinforcing support to the first support rail as the cover leans thereon.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
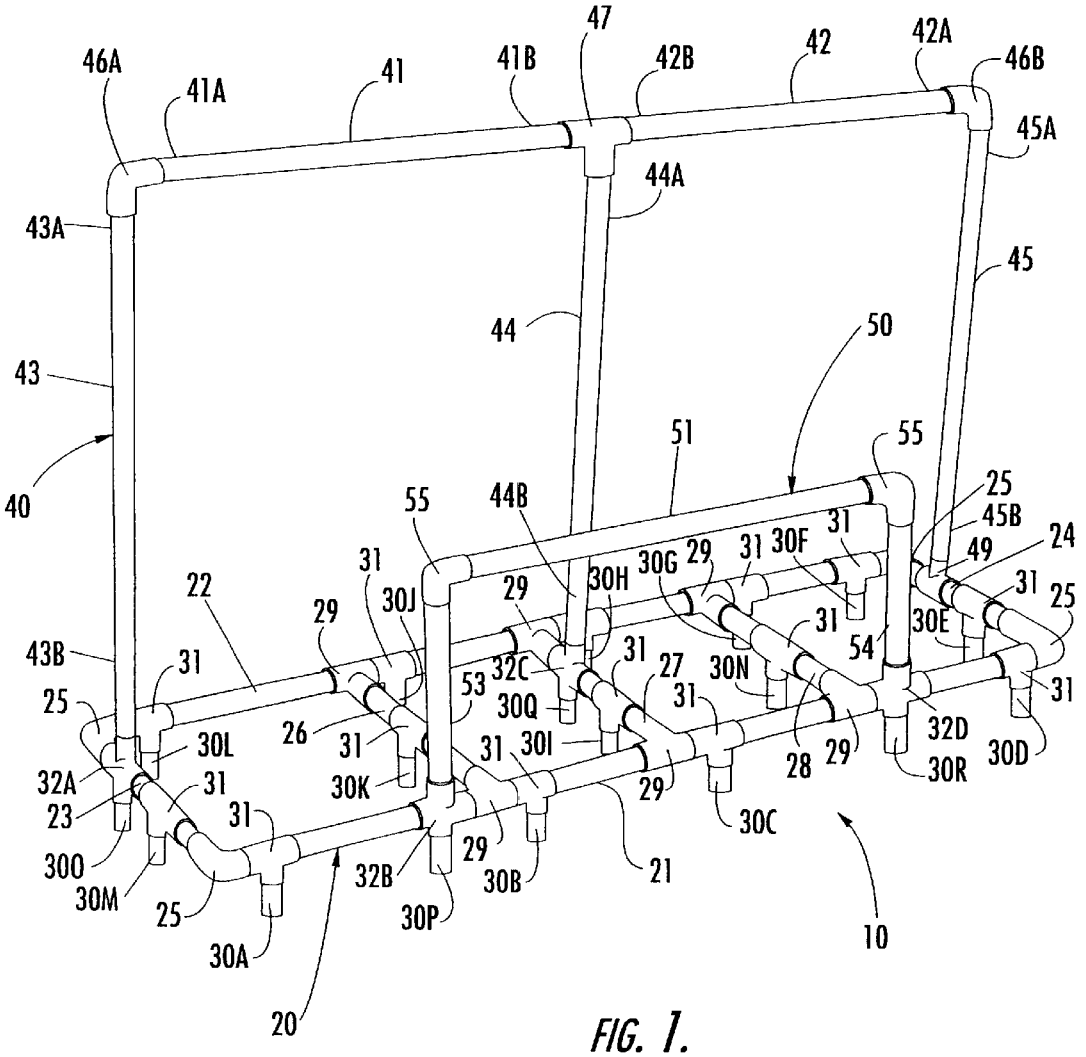
FIG. 1 is a perspective view of a spa cover holder according to one preferred embodiment the invention.

Referring now to FIG. 1, a spa cover holder according to the present invention is illustrated and shown generally at reference numeral 10. The cover holder 10 is preferably formed from ¾ inch tubing, and includes a horizontally-oriented base 20 to which first and second vertically-oriented support rails 30 and 40 are connected. The base 20 preferably has a length of 5 feet and a width of 17 inches. The base 20 includes first and second horizontally-oriented major base rails 21 and 22, respectively, which are positioned in spaced-apart relation to one another and are connected to first and second minor base rails 23 and 24 by a respective one of four identical connecting elbows 25. The base 20 also includes three horizontally-oriented base rail segments 26, 27 and 28 which are positioned between and extend perpendicularly to the major base rails 21 and 22. Base rail segments 26, 27, and 28 are connected to major base rail 21 by a respective one of six identical connecting tees 29. The minor base rails 23 and 24 and base rail segments 26, 27, and 28 function as five joists that cooperate with one another to hold the base 20 together, and are positioned between the major base rails 21 and 22 in the manner shown in FIG. 1 to ensure that the weight of a spa cover positioned on the cover holder 10 is properly distributed.

As is shown in FIG. 1, the base 20 also includes eighteen identical legs 30A–30R which are positioned in spaced-apart relation to one another and connected to one of either the first and second major base rails 21 and 22, the minor base rails 23 and 24, or the base rail segments 26, 27, and 28. Each of the legs 30A–30R is preferably 5 inches long. While the legs 30A–30R may be mounted anywhere on the base 20, they are preferably spaced apart along the base 20 in a manner which ensures that the legs 30A–30R will provide proper balance to the cover holder 10 when a spa cover is positioned thereon. As is shown in FIG. 1, each of the legs 30A–30R is attached to the base 20 so that it extends perpendicularly from the base 20 and in a direction opposite to that of the vertically-oriented support rails 40 and 50. Each of the legs 30A–30M is connected to the base 20 by a respective one of thirteen identical connecting tees 31. Legs 300, 30P, 30Q and 30R are connected to minor base rail 23 and base rail segment 27 by identical connecting crosses 32A, 32B, 32C and 32D, respectively.

The vertically-oriented support rail 40 extends along the length of the major base rail 22 and is positioned perpendicularly to the base 20. Support rail 40 is preferably has a length of 60 inches, and includes two elongate horizontal support members 41 and 42 which are connected to the base 20 by first, second, and third vertical support members 43, 44 and 45, respectively. First, second, and third vertical support members 43, 44 and 45 each preferably have a length of 34 inches. Support member 41 has a first end 41A which is connected to an upper end 43A of support member 43 by a connecting elbow 46A. Support member 42 similarly has a first end 42A which is connected to an upper end 45A of support member 45 by a connecting elbow 46B. Second ends 41B and 42B of support members 41 and 42 are connected together and to an upper end 44A of support member 44 using a connecting tee 47. Support member 44 provides supplemental support to the cover holder 10 by reinforcing the support member 40.

As is shown in FIG. 1, the vertical support members 43,44, and 45 also include respective lower ends 43B, 44B and 45 B. Lower end 43B is connected to minor base rail 23 by connecting cross 32A. Lower end 44B is connected to base rail segment 27 by connecting cross 32B, and lower end 45B is connected to minor base rail 24 by a connecting tee 49. While the lower ends 43B, 44B and 45B may be connected to respective minor base rail 23, base rail segment 27, and minor base rail segment 24, respectively, at any suitable locations, the lower ends 43B, 44B and 45B are preferably connected thereto twelve inches from the first major base rail 21, and five inches from the second major base rail 22. Attaching the vertically-oriented support rail 40 in an offset position relative to the center of the minor base rails 23 and 24 permits the cover holder 10 to remain properly balanced after a spa cover is positioned on the base 20. Without such balance, both the cover holder 10 and a spa cover positioned thereon would tilt and fall over.

The structure of the second vertically-oriented support rail 50 is also shown in FIG. 1. The second vertically-oriented support rail 50 extends along part of the length of the major base rails 21 and 22, and includes an elongate horizontal support member 51, which is connected to first and second minor vertical support members 53 and 54 by a respective one of two identical rounded connecting elbows 55. Horizontal support member 51 is preferably has a length of 33 inches. The minor vertical support members 53 and 54 are connected to major base rail 21 by connecting crosses 32B and 32D, respectively. While vertical support members 53 and 54 may be connected to the major base rail 21 at any suitable locations, support member 53 is preferably connected to the base rail 21 13½ inches from the minor base rail 23, and support rail 54 is preferably connected to the bare rail 21 13 ½ inches from the minor base rail 24. Vertical support members 53 and 54 each preferably have a length of 13 inches. When assembled on the base 20, the vertically-oriented support rail 50 supports a spa cover inserted between the support rails 40 and 50, and prevents the cover from moving around on the base 20. Using the rounded connecting elbows 55 and placing the support rail 50 at a lower height relative to that of support rail 40 permits a cover to be easily positioned on the base 20 between the support rails 40 and 50 without tearing or otherwise damaging the cover.

Figure 2:
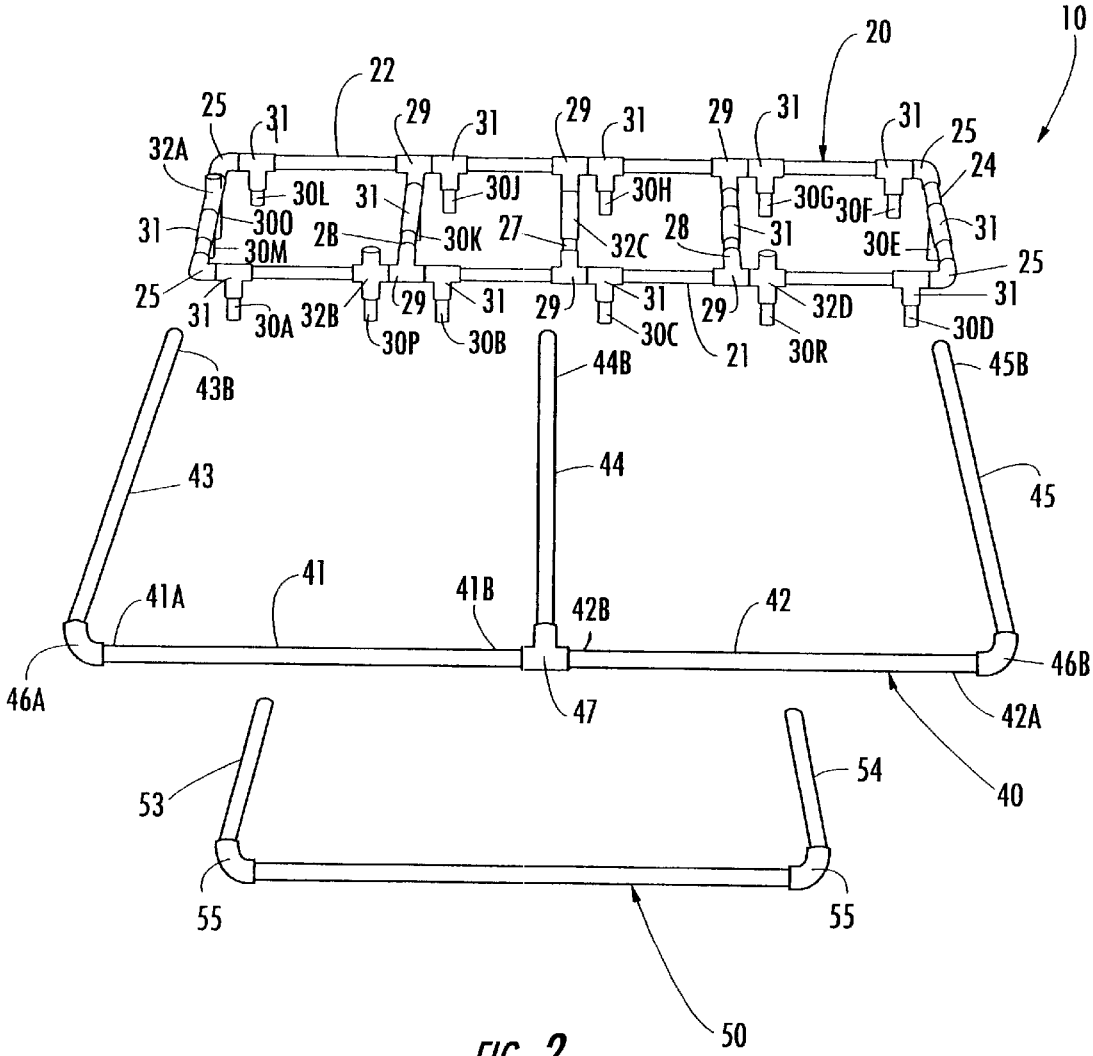
FIG. 2 is a perspective view of a spa cover holder according to FIG. 1 during assembly.
Figure 3:
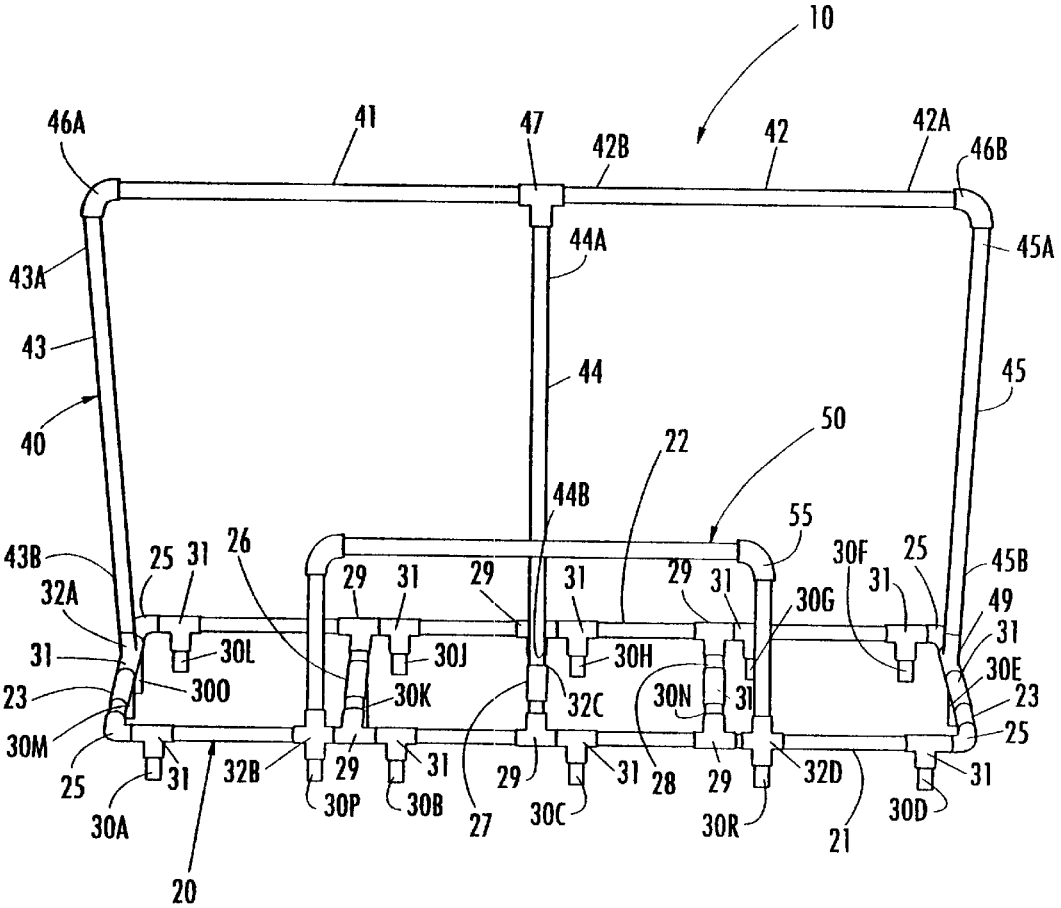
FIG. 3 is another perspective view of the spa cover holder shown in FIG. 1.

Referring now to FIG. 2, the cover holder 10 is shown prior to installation with the first and second vertically-oriented support rails 40 and 50 removed from the base 20. The size of the vertically-oriented support rail 40 may be adjusted to fit the size of the particular cover which is to be stored on the holder 10. To adjust the size of the support rail 40, the lower ends 43B and 44B of first, second and third vertical support members 43, 44 and 45, respectively, are each cut to the desired length. Each support member 43, 44, and 45 should by measured prior to cutting to ensure that the vertically-oriented support member 40 is adjusted to the correct height. FIG. 3 shows the cover holder 10 after assembly is completed.

Figure 4:
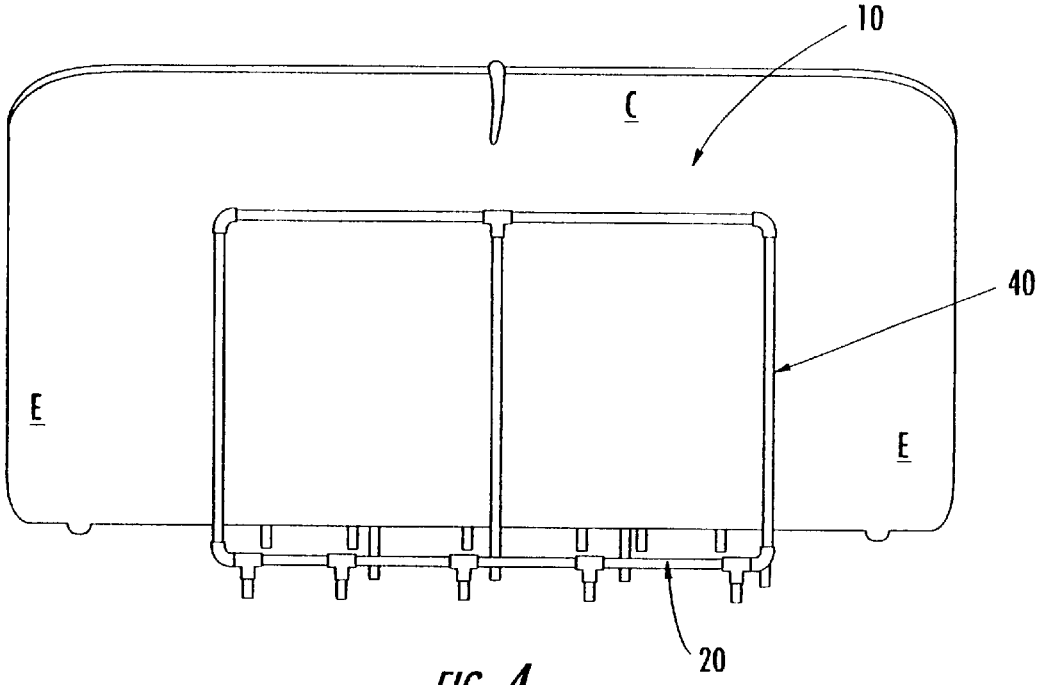
FIG. 4 is a front perspective view of a spa cover holder according to FIG. 1 showing a spa cover positioned thereon.
Figure 5:
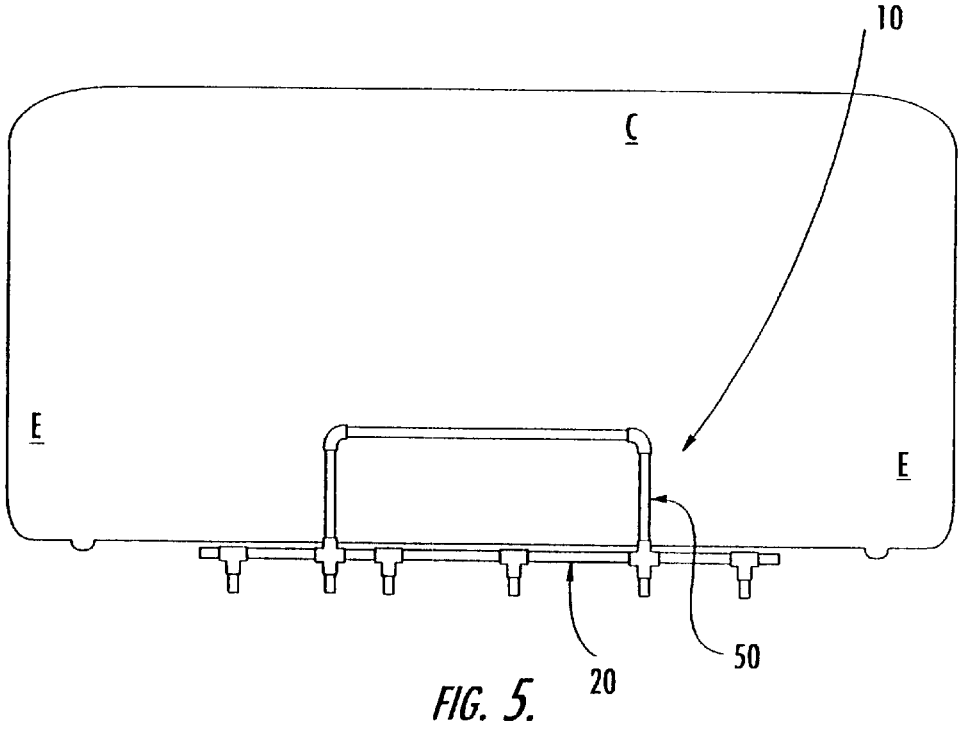
FIG. 5 is a rear perspective view of a spa cover holder according to FIG. 1 showing a spa cover positioned thereon.

Referring now to FIGS. 4 and 5, the cover holder 10 is shown during use. FIG. 4 shows a spa cover "C" positioned on the cover holder 10 and leaning against the vertically-oriented support rail 40. To position the cover "C" in the cover holder 10, the cover "C" is first removed from the spa (not shown). The cover "C" is then folded in half, or as otherwise instructed by the manufacturer of the cover "C". The cover "C" is grasped by both ends "E" or handles (not shown), and is positioned on the base 20 between the vertically-oriented support rails 40 and 50. FIG. 5 shows the front of the cover holder 10, with the cover "C" held in place on the base 20 by the vertically-oriented support rail 50.

A spa cover holder is described above. Various details of the invention may be changed without departing from its scope. Furthermore, the foregoing description of the preferred embodiment, of the invention and the best mode for practicing the invention are provided for the purpose of illustration only and not for the purpose of limitation—the invention being defined by the claims.

What I claim as my invention is:

1. A freestanding spa cover holder for storing a cover holder for storing a cover when not in place on the spa, comprising:

(a) a horizontally-disposed base, including:

(i) first and second horizontally-oriented and spaced apart major base rails; and (ii) first and second horizontally-oriented and spaced apart minor base rails perpendicularly disposed between and connected to said opposing major base rails; and (b) a tall first support rail having first and second ends mounted on said first and second minor base rails, respectively, at such a location offset from a center thereof so as to permit a spa cover resting against said first support rail to assume a balanced position of the base, the first support rail positioned between and extending upwardly along the entire length of the major base rails at a perpendicular angle thereto, having a first predetermined height, and defining a back support against which the cover is received; and (c) a low second support rail mounted on said second major base rail in spaced-apart relation to the first support rail and extending along less than the entire length of the major base rails, said second support rail having a second predetermined height at least less than one half of said first predetermined height and defining with the base and the first support rail a structure for permitting the cover to be positioned between the first and second support rails for full support of a leaning side of the cover against the first support rail while permitting the cover to be lifted only over the low second support rail when placing the cover in and removing the cover from the holder.

2. A spa cover holder according to claim 1, wherein said second support rail extends along the length of the first major base rail and includes first and second ends connected thereto.

3. A spa cover holder according to claim 1, wherein said second support rail extends along the length of the second major base rail and includes first and second ends connected thereto.

4. A spa cover holder according to claim 1, and including a plurality of vertically-oriented, spaced apart support legs connected to the base in a predetermined configuration and extending outwardly therefrom in a direction opposite the first and second support rails for supporting and maintaining the cover holder above the surface upon which the cover holder is positioned.

5. A spa cover holder according to claim 1, wherein said base further comprises at least one horizontally-oriented base rail segment having one end connected to a respective one of the first and second major base rails and the other end connected to the other one of the first and second base rails for providing reinforcing support to the base.

6. A spa cover holder according to claim 5, and including a plurality of vertically-oriented, spaced apart support legs connected to the major and minor base rails and said at least one base rail segment in a predetermined configuration and extending outwardly away therefrom in a direction opposite the first and second support rails for supporting and maintaining the cover holder above the surface upon which the cover holder is positioned.

7. A spa cover holder according to claim 5 or 6, and including a vertically-oriented reinforcing rail having one end connected to the first support rail between the first and second ends thereof, and the other end connected to one of the base rail segments for providing reinforcing support to the first support rail as the cover leans thereon.

* * * * *

UNITED STATES PATENT AND TRADEMARK OFFICE

CERTIFICATE OF CORRECTION

PATENT NO. : 6,324,708 B1
DATED : December 4, 2001
INVENTOR(S) : Langley, Joe L.

It is certified that error appears in the above-identified patent and that said Letters Patent is hereby corrected as shown below:

Column 5,
Line 3, delete "of" and insert -- on --.

Signed and Sealed this

Twentieth Day of August, 2002

*Attest:*

*Attesting Officer*

JAMES E. ROGAN
*Director of the United States Patent and Trademark Office*